US010119328B2

(12) United States Patent
Sinnathamby et al.

(10) Patent No.: US 10,119,328 B2
(45) Date of Patent: Nov. 6, 2018

(54) FRAME STRUCTURE FOR A WINDOW AND A METHOD FOR MAKING A FRAME STRUCTURE

(71) Applicant: VKR HOLDING A/S, Hørsholm (DK)

(72) Inventors: Ruben Sinnathamby, Viby J (DK); Michael Melsen, Lemming (DK); Kristian Ørnsvig Nielsen, Hornsyld (DK)

(73) Assignee: VKR Holding A/S (DK)

( * ) Notice: Subject to any disclaimer, the term of this patent is extended or adjusted under 35 U.S.C. 154(b) by 234 days.

(21) Appl. No.: 14/400,256

(22) PCT Filed: May 10, 2013

(86) PCT No.: PCT/DK2013/050141

§ 371 (c)(1),
(2) Date: Nov. 10, 2014

(87) PCT Pub. No.: WO2013/167144

PCT Pub. Date: Nov. 14, 2013

(65) Prior Publication Data

US 2015/0096257 A1 Apr. 9, 2015

(30) Foreign Application Priority Data

May 11, 2012 (DK) ..... PA 2012 70243

(51) Int. Cl.
*E06B 3/96* (2006.01)
*E06B 3/20* (2006.01)
(Continued)

(52) U.S. Cl.
CPC ..... *E06B 3/96* (2013.01); *E06B 1/70* (2013.01); *E06B 3/205* (2013.01); *E06B 3/263* (2013.01);
(Continued)

(58) Field of Classification Search
CPC ... E06B 3/96; E06B 3/72; E06B 3/263; E06B 3/9636; E06B 1/70; E06B 3/20;
(Continued)

(56) References Cited

U.S. PATENT DOCUMENTS 3,111,569 A * 11/1963 Rubenstein ..... B28B 23/0006 206/226
3,470,598 A * 10/1969 Berthelsen Viggo ..... B29C 47/025 228/142
(Continued)

FOREIGN PATENT DOCUMENTS

CA 2752422 A1 * 8/2009 ..... B29C 44/086
DE 19516486 A1 11/1996
(Continued)

*Primary Examiner* — Jessica L Laux
(74) *Attorney, Agent, or Firm* — Merek, Blackmon & Voorhees, LLC

(57) ABSTRACT

The invention relates to a frame structure, such as a window sash or a frame for a window or door, comprising a core made from at least one core member made from expanded polystyrene (EPS) with a density of 80-200 kg/m$^3$ and a shell of polyurethane (PUR) encasing the core. The core may include a plurality of core members, some of which may be made from a different material.

4 Claims, 6 Drawing Sheets

(51) Int. Cl.
*E06B 1/70* (2006.01)
*E06B 3/263* (2006.01)
*E06B 3/72* (2006.01)
*E06B 3/34* (2006.01)

(52) U.S. Cl.
CPC ..... *E06B 3/72* (2013.01); *E06B 3/9636* (2013.01); *E06B 3/341* (2013.01); *Y10T 29/49826* (2015.01); *Y10T 29/49837* (2015.01); *Y10T 156/10* (2015.01)

(58) Field of Classification Search
CPC ..... E06B 3/205; E06B 3/221; E06B 3/306; E06B 3/307; E06B 3/308; E06B 2003/224; E06B 2003/225; E06B 2003/226
See application file for complete search history.

(56) References Cited

U.S. PATENT DOCUMENTS 4,130,976 A * 12/1978 Kesseler ..... E06B 3/205 264/171.12
4,327,142 A * 4/1982 Norzi ..... B29C 44/0461 156/276
4,720,951 A * 1/1988 Thorn et al. ..... 52/208
5,142,835 A * 9/1992 Mrocca ..... B29C 70/865 52/309.11
5,557,899 A * 9/1996 Dube et al. ..... 52/455
5,602,188 A * 2/1997 Nakanishi ..... B29C 44/428 264/45.9
5,833,796 A * 11/1998 Matich ..... A42C 2/00 156/212
5,899,026 A * 5/1999 Williams et al. ..... 52/58
6,619,005 B1 * 9/2003 Chen ..... 52/455
6,931,822 B1 * 8/2005 Christen ..... B29C 63/04 53/222
7,178,308 B2 * 2/2007 Fagan et al. ..... 52/800.1
7,185,468 B2 * 3/2007 Clark ..... B32B 5/22 52/309.9
8,938,927 B1 * 1/2015 Bragg ..... E04F 13/0803 52/483.1
2005/0281999 A1 * 12/2005 Hofmann ..... B32B 5/18 428/304.4
2006/0101735 A1 * 5/2006 Silverman ..... B29C 45/14065 52/204.1
2011/0306691 A1 * 12/2011 Sosa ..... B29C 44/08 521/79
2012/0137607 A1 * 6/2012 Kristensen et al. ..... 52/204.62
2012/0266554 A1 * 10/2012 Fifield ..... E04F 13/0803 52/302.1
2014/0030457 A1 * 1/2014 Kim ..... B63B 5/24 428/36.5
2015/0150380 A1 * 6/2015 Oh ..... B29C 44/1285 297/452.18
2015/0150381 A1 * 6/2015 Lee ..... A47C 7/46 297/452.18

FOREIGN PATENT DOCUMENTS

DE 29718915 U1 5/1998
DE 19853212 A1 5/2000
DE 102008009495 2/2008
WO WO9722779 A1 6/1997
WO WO2007057029 A1 5/2007
WO WO2010088905 A1 12/2010
WO WO2013050045 A1 4/2013

* cited by examiner

FRAME STRUCTURE FOR A WINDOW AND A METHOD FOR MAKING A FRAME STRUCTURE

TECHNICAL FIELD

The present invention relates to a frame structure, such as a window sash or a frame for a window or door, including side, top and bottom pieces, the frame structure comprising a core made from at least one core member and a shell of polyurethane encasing the core, and to a method for making such a frame structure.

BACKGROUND

Traditional wooden frame structures are considered aesthetically pleasing but are not very robust, particularly not when exposed to moisture, and they lack the insulating properties wanted in modern buildings.

The robustness issues have been solved with window frames made from polyvinyl chloride (PVC), which is very widely used, while other window makers, including the applicant, have chosen to make the frames from profiles with a wooden core, typically of plywood, and a polyurethane (PUR) shell. Other plastic materials have also been used for the shell, but PUR is by far the most widely used, since it has suitable properties with regard to weather resistance, insulation, mouldability etc.

These frames, however, still lack sufficient insulating properties to live up to still stricter building regulations, which are being adopted in many countries, and it has therefore been attempted to include insulating materials in the frame structure. One example of this is the applicant's own prior patent application WO2007/057029, where the core is made at least partially of heat-treated wood, which has improved insulating properties; another, DE19516486A1, where the core is made from insulating foam.

In DE19516486A1 the preferred insulating material was foamed PUR covered by a PUR shell and it was explained that the shell and the core should preferably be made from the same material to ease recycling. No other materials were mentioned and practice showed that very few other commercially available materials are in fact suitable for use in the core, and that most of these are too costly for practical use.

As PUR too is a relatively expensive material, it is the object of the invention to provide an alternative and cheaper frame structure still having good thermal insulating properties.

SUMMARY OF THE INVENTION

In response to the limitations and problems encountered in the art, a frame structure has been discovered in which at least one core member is made from expanded polystyrene (EPS) with a density of 80-200 kg/m3.

For a long time expanded polystyrene (EPS) has been considered unsuitable for use in moulded PUR frames. Firstly, the EPS tended to deteriorate by compression and melting and, secondly, the cores tended to get displaced in the mould during the moulding of the PUR shell.

When working with the present invention, it was, however, surprisingly shown that the EPS could be made with a much higher density than what has previously been possible within reasonable economic limits and that such an extremely high density EPS is in fact suitable for use in frames with a PUR shell. A density interval of approximately 100-200 kg/m$^3$ and more specifically 120-170 kg/m$^3$ proved to provide a particularly good balance between insulating properties, costs and manageability, and a density of approximately 150-160 kg/m$^3$ is presently considered advantageous. It is noted that the density need not be constant across the core member, but that one or more core members may includes zones of different density expanded polystyrene. As an example an outer layer may have a density of approximately 150 kg/m$^3$ and a centre a density of approximately 100 kg/m$^3$. The transition between such zones may be well defined, but due to the nature of EPS it will normally be expedient to have a gradual variation of the density, meaning that at least a part of the cross-section of the core member is characterized by a smooth increase and/or decrease in the EPS density.

It has also been discovered that the addition of additives, such as polyphenylether, to the polystyrene can make the EPS material more resistant to high temperatures. Such materials, which are known as High Temperature EPS or EPS HT, form a relatively hard outer layer and are therefore less sensitive to compression and melting than EPS without such additives. It is therefore possible to use core members with a somewhat lower density and hence EPS HT is particularly advantageous in core members with a density of 80-100 kg/m3.

It is to be understood that even though the core may be made from several core members, some of which may be made from different materials, the core is advantageously made primarily from EPS, including EPS HT, and that, in its simplest form, the core may consist of only a single core member.

It is presently preferred that at least 90% by volume of the core is made from EPS with a density of 80-200 kg/m3, but cores with at least 80% by volume or even 50% by volume also presents considerable advantages. Likewise it is to be understood that different core members may be made of EPS with different densities, some for example being made with a density of 120 kg/m3 and others with a density of 150 kg/m3.

In order to facilitate manufacture and allow an optimization of the properties of the core, it may be made from a plurality of core pieces, each of the core pieces including at least one core member formed from EPS. Conveniently, the plurality of core pieces may total four core pieces corresponding to the side, top, and bottom pieces of the frame structure and the core pieces may then be given different properties corresponding to the different demands on the top, bottom and side frame pieces. As an example, additional core members in the form of metal brackets, polymer blocks or plugs and/or slats of plywood may be provided in the side core pieces at the intended location of window hinges to constitute a basis for fastening thereof and to transfer loads either to other parts of the frame structure or to a load-bearing structure, such as a roof structure. Other window components, such as a locking assembly, may also benefit from the provision of a non-EPS core member, which contributes to taking up loads.

Examples of other possible materials are fiberglass, ceramics and wood- or plant-based materials, such as pine, chipboard, bamboo or hemp fibers that have possibly been subjected to heat-treatment, acetylation or impregnation to avoid excessive humidification and/or deterioration. Such core members serving as inserts may also be embedded in the shell and/or be used to provide for example a base for mounting of auxiliary elements, such as striking plate and lining, and/or at the corners of the frame structure to strengthen the construction.

Core members made from other materials than EPS may advantageously be inserted in or attached to an EPS core member prior to it being encased in polyurethane, possibly by the use of welding, adhesives, or glue to provide a good interconnection. If the non-EPS has to be located at the centre of the cross-section of the finished frame or otherwise surrounded by EPS, two EPS core members may be sandwiched around it, but it also possible to embed such a core member in the EPS during making of the EPS core member. Alternatively, the non-EPS core member may be inserted in the core after encasement and possibly fixated by means of an adhesive or glue.

The use of insert core members may be supplemented or even replaced by the shell having at least one section of increased thickness, which may provide the needed reinforcement for strength and/or attachment of hinges and fittings. Such sections of increased thickness may be achieved by making the core of at least one frame or sash piece with variations in its cross-sectional shape over the length of the frame or sash piece.

The core members may be shaped by any suitable process, but the resulting outline or cross section of the core should preferably be relatively smooth with rounded edges to facilitate flow of the PUR, whereby the production time is reduced and a high quality coated frame structure may be achieved. Milling and sawing of the EPS materials inevitably results in some of the EPS beads being broken and left open and using a hot-wire for cutting is presently not feasible due to the high density. Therefore it is presently preferred to shape the core members by moulding, preferably using hot water vapor.

If choosing a design of the frame, which requires relatively large amounts of the PUR to be supplied to certain areas, it may also be advantageous to make the core members with holes or canals, which may then serve as high flow passages for the PUR. Such holes or canals should of course be provided with due consideration for the insulating properties and strength of the frame structure and will be filled wholly or partially with PUR, when the core is encased.

Holes or canals in the core members may also be provided for use as points of attachment for fixing means such as screws or bolts used for example for mounting the window or for attaching other items such as hinges, cladding parts or shutters. As an example, a hole in the core member, which is filled with PUR as described above, may be used to receive screws driven into the frame structure, but it is also possible to provide a separate receiver, such as a Rawlplug® connector from Koelner Rawlplug Ip Spolka Z O.O. LLC, embedded in the core member and/or PUR. Other alternatives include the provision of holes, which stays open during moulding of the PUR, e.g. by being filled by a mandrel during the moulding, and allowing a bolt to pass through the frame structure or an expandable fastener to engage an undercut or widening in the hole.

The provision of holes, which penetrate all the way through the core and which are filled wholly or partially with PUR, results in connections between the PUR layers of each side and may therefore be used for strengthening and/or stiffening purposes.

The moulding process, which will not be described in detail here as it is known to skilled persons, consists in introducing EPS beads in a closed mould and applying pressure and heat, preferably by the introduction of hot water vapor. This applies both when the core is moulded in one piece and when core members are moulded separately.

As an alternative to the use of hot water vapor the EPS beads may be interconnected by adhesion, for example by means of epoxy or an acrylic resin.

This method of manufacture makes it possible for core members of a different material, such as for example a reinforcing metal profile, to be located in the center of one or more core pieces, which would otherwise require the making of several EPS core members to be sandwiched around the insert.

Joining of core members and/or core pieces of the frame structure may be accomplished by any suitable joining means, such as clamps, staples, welding, adhesives, glue etc., including epoxy or an acrylic resin. In an embodiment of the invention the core members are assembled with dovetail joints. Hereby the frame structure may be assembled quickly and with relative ease without need for special tools.

Joints may be stabilized by allowing the PUR material to flow into the gaps between the core members and/or core pieces, where it sets, thus functioning as a glue.

As the joint is completely encased in PUR, the surface of the frame structure is closed and impervious making the frame structure weatherproof and robust.

It is also possible to pre-treat the surface of the core member(s) with an adhesion promoting surface profiling or surface covering to facilitate adherence. This may be accomplished in a number of ways, such as by etching the surface of the mould used for making the core, by applying a suitable primer, or the like. It is presently preferred to roughen the surface of the EPS to provide a surface having improved adherence characteristics, the roughening entailing an increase in the area of the contact surface between the core and the shell. Such roughening may for example be achieved by providing a mould used for making core members with a surface profiling, which may for example be done by photo etching. A zigzag pattern with a depth of approximately 1 mm in the surface of the core member has been shown to provide a good adherence of PUR.

BRIEF DESCRIPTION OF THE DRAWINGS

In the following, the invention will be described in more detail by way of example and with reference to the drawing, in which.

DETAILED DESCRIPTION

Reference will now be made in detail to the presently preferred embodiments of the invention, one or more examples of which are illustrated in the figures. Each example is provided by way of explanation of the invention and not meant to be a limitation of the invention. For example, features illustrated or described as part of one embodiment may be used with a different embodiment to yield yet still another embodiment. It is intended that the present application include such modifications and variations as come within the scope and spirit of the invention. Selected combinations or aspects of the disclosed technology correspond to a plurality of different embodiments of the present invention. Certain features may be interchanged with similar devices or different features not expressly mentioned that perform the same or similar functions.

Figure 1:
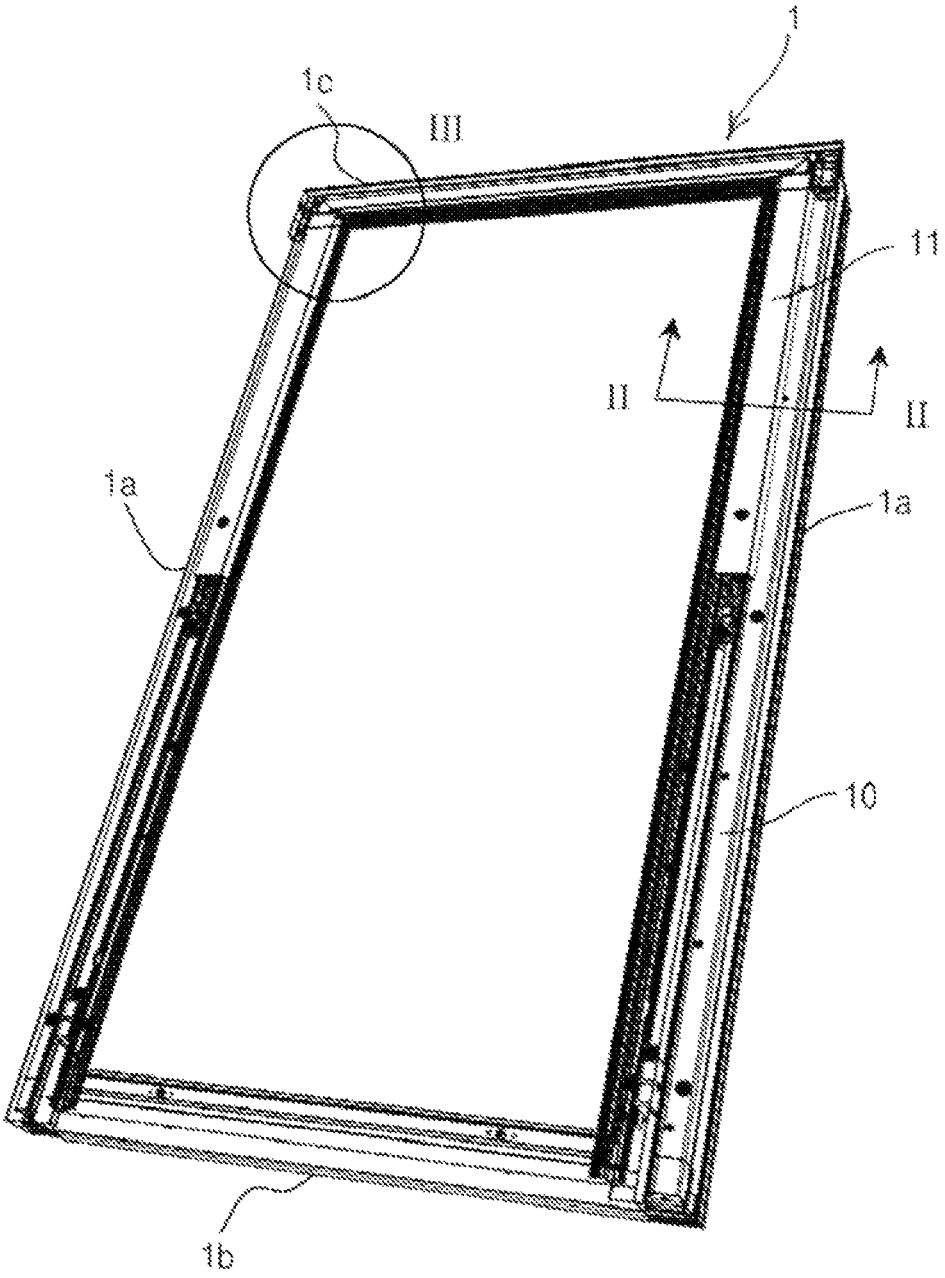
FIG. 1 is a perspective view showing a window frame according to the invention.

The frame structure in FIG. 1 is a window frame 1 having two side pieces 1*a*, a bottom piece 1*b* and a top piece 1*c*. As will be described in further detail below, the structure of the individual frame pieces may vary within the general principle underlying the invention, i.e. that a core including at least one core member formed from high density and/or high temperature expanded polystyrene (EPS) is encased in a polyurethane shell.

It will be evident to the skilled person that the window frame is only an example, and that the invention applies to other profile element constructions, such as a window sash or a door frame.

Figure 2:
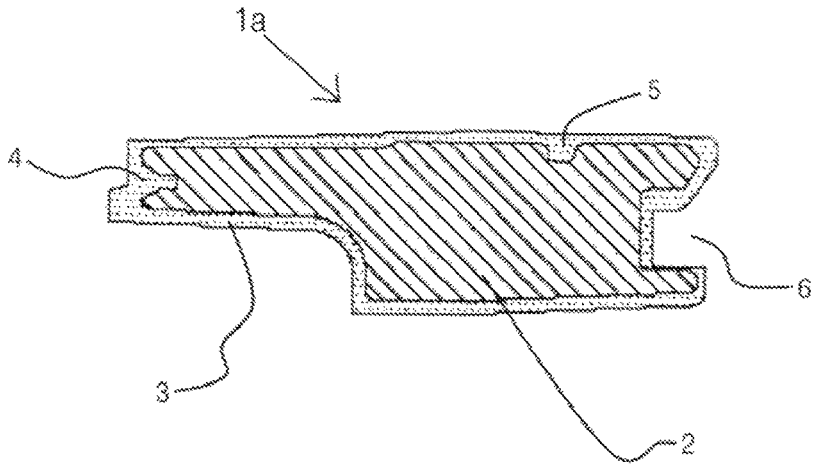
FIG. 2 is a cross-sectional view of a detail of the window frame along the line II-II in FIG. 1 with cladding and coverings members etc. removed.

In the drawing of FIG. 2 a cross-sectional view of a window frame side piece 1*a* according to the invention can be seen. The side piece 1*a* comprises a core consisting of a core member 2 of high density EPS encapsulated in a shell in the form of a surface layer 3 formed of foamed polyurethane (PUR).

The cross-section shown in FIG. 2 comprises recesses 4 and 5 in the core member, which are not used at this position on the frame, but have a function elsewhere along the frame side piece, serving for example to receive screws. If opting for a side core piece with a non-constant cross sectional shape, these recesses could be replaced by local depressions in the core member(s). Another recess 6 is adapted for receiving a lining and is therefore not filled with the shell material.

The ideal thickness of the PUR shell is a balance of integrity of the resulting frame structure, material cost, insulation properties etc. The PUR material is, however, relatively expensive, and the thickness should therefore be kept at a minimum, but practical problems relating to moulding of the plastic sets a lower value of about 1 mm. A suitable interval of the average thickness of the plastic material is 1 to 8 mm, preferably at least 2 mm and maximum 5 mm.

In this embodiment the core is covered entirely by the PUR shell, but it is to be understood that there may be openings in the shell exposing the core without departing from the scope of the invention.

The PUR material is preferably an integral PUR foam having a density of in the interval 100-800 kg/m3 and good results has been achieved with a density of approximately 600 kg/m3. This foam provides a hard, robust, weatherproof and neat surface, which provides strength and stiffness and is easy to clean. If superior properties are needed a massive integral foam having a density in the interval 800-1200 kg/m3 could be chosen.

With regards to the EPS, good results were achieved with EPS foamed with pentane and moulded with water vapor to a density of approximately 120-150 kg/m3, 150 kg/m3 being presently preferred, and for high temperature EPS with a density of approximately 80-100 kg/m3.

Figure 3:
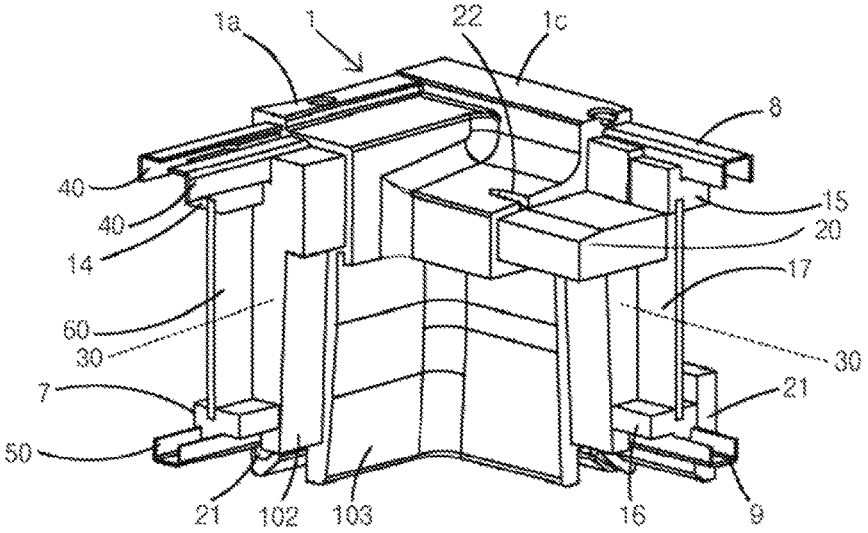
FIG. 3 is a cross-sectional perspective view of a corner of a window frame as marked with the circle III in FIG. 1, but according to a second embodiment of the invention and with cladding and coverings members etc. removed.

FIG. 3 depicts a cross-sectional view of the corner between the left side piece 1*a* and the top piece 1*c* of a window frame as the one in FIG. 1, but in a different embodiment than the one shown in FIG. 2. Elements having the same function as those already described with reference to FIG. 2 have been given the same reference numbers but with 100 added.

As can be seen, the frame structure 1 here has a relatively complicated lay-out and is made up from a series of parts and materials, of which a varying number may be present depending on the requirements with regard to, e.g., strength, stiffness, and thermal insulation and which may vary over the length of the individual frame pieces.

As the EPS core 102 has a relatively low strength and stiffness, reinforcing elements are provided. These include two angle bars 40 and a U-shaped bar 50 provided at cross-sectional corners of the side piece 1*a*, whereas the top piece 1*c* is provided with two U-shaped bars 8, 9. The reinforcing angle bars 40 and U-shaped bars 50, 8, 9 may be provided adjacent the inner side of the outer shell 103 or, as presently preferred, embedded in the outer shell 103, but covered thereby, whereby the bars are invisible from the outside. The best results with regard to stiffness and strength is achieved when the reinforcing bars are arranged remote from a central axis 30 of the frame piece. The bars may extend in the full length of frame pieces 1*a*, 1*b*, 1*c* making up the frame, or cover only part of the length and may be mutually connected at the corners of the frame structure to further increase stiffness and strength.

The bars 40, 50, 8, 9 may be made of metal or of a high-strength plastic and/or fiber material, possibly pultruded. In the embodiment shown, the angle bars has a thickness of 1.5 mm and each leg of the angle has a length of 10 mm, whereas the U-shaped bars has a thickness of 1.5 mm, each leg has a length of 8 mm and the back has a length of 16 mm.

The side piece 1*a* and the top piece 1*c* shown are further provided with inserts, the function of which is to further improve the stiffness and strength of the frame. The side piece 1*a* comprises an insert in the form of a plate element 60 anchored in a first anchor 7 and a second anchor 14, the anchors 7, 14 being in turn held by the U-shaped bar 50 and the angle bars 40. The insert may hence also provide a means to assemble and hold the reinforcing elements prior to and during moulding of the core 102 and the outer shell 103. Similarly, the top piece 1*c* is provided with a plate element 17 anchored in anchors 15 and 16. The plate elements 17, 60 and the anchors 7, 14, 15, 16 may be made of metal or a plastic and/or fiber material, and the plate element and anchors need not be made of the same material. The inserts can, as shown, be assembled from separate parts or alternatively, the inserts may be of integral construction, such as an injection moulded or pultruded plastic bar. It is preferred that the inserts are embedded in the core 102 to avoid or at least reduce formation of thermal bridges. For the same reason the inserts may be positioned with spacers in relation to the outer shell and reinforcing elements, so that the inserts are completely surrounded by the core material. The inserts may extend over the whole length of the elements, but it is presently preferred to have such strengthening inserts only at corners of the frame structure, so that the inserts only extend to a limited distance from the frame corner. Alternatively, the corner area of the profile element construction may be reinforced by having integral webs or diagonal braces formed of the material of the outer shell.

Additional inserts (not shown) may be used to strengthen the construction at fittings, brackets and hinges.

Optionally the frame may be provided with a slat 20, here shown only in the top frame piece 1*c*, which may be of wood, plywood or a suitable plastics material, to provide support for a striking plate and a firm basis to allow mounting of screws in the profile elements. Openings 22 or weakening are provided in the outer shell 103 to allow the insertions of such fasteners.

Further slats 21 may be provided to allow mounting of screws, nails or other fastening means at other locations on the profile element construction, here in the side piece 1*a*. This may for example be convenient for mounting of linings or the like.

The reinforcing slats 20, 21 or like elements may be separate elements or assembled to constitute a closed frame and they may extend along the entire length of the side and top pieces 1*a*, 1*c*.

Figure 4:
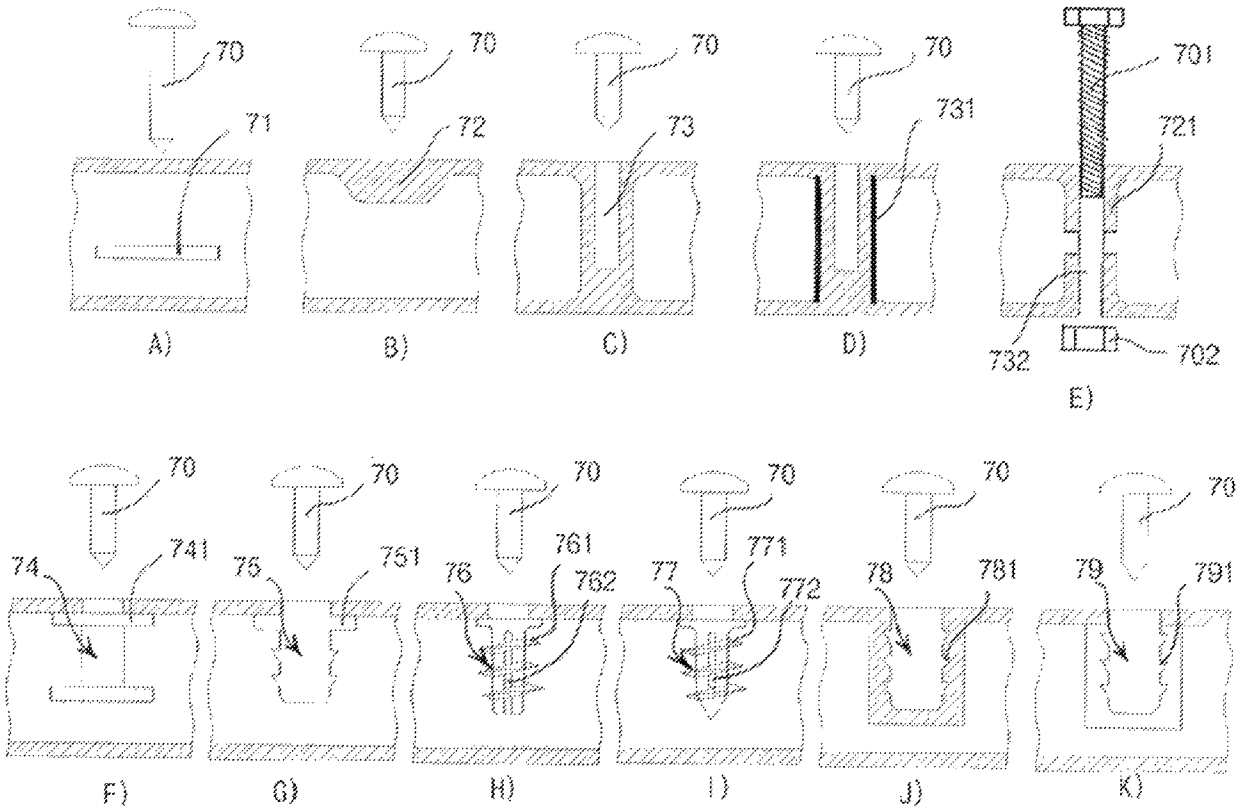
FIG. 4 is a series of partially cut-away cross-sectional sketches of different ways of securing a screw or peg to a frame structure.

Alternative means for allowing a secure attachment of different window parts, such as fittings, brackets, hinges, covering, claddings, shutters or the like, by means of screws or like fasteners 70 are shown in FIG. 4.

Detail A) at the top left corner shows the use of an insert 71 for receiving the screw or peg 70. The insert may serve only as a receiver preventing the screw or peg from being pulled out of the frame when affected by loads, but it may also serve to distribute the loads onto the frame material and/or a load-bearing structure. Alternatively or as a supplement, an insert of this type may have other functions, for example being an electrical conductor, and the fastener 70 may then be replaced by an electrical plug. Here the insert is shown as located slightly below the centre of the frame profile, which is an advantageous position when serving as a reinforcement for taking up bending loads, but is may also be located elsewhere and may even be in contact with the PUR shell. Likewise, the shape of the insert may vary and bends or projections may be used for establishing a contact between the embedded insert and the outer surface of the frame. It is also to be understood that the frame profile may contain more than one insert, an example being the combination of one serving reinforcing purposes and another being an electrical conductor.

Detail B) shows the provision of a thickening 72 in the PUR layer, which gives the frame more strength and stiffness, thus for example making it better suited for the attachment of hinges. This way of attaching the screw or peg 70 has been described above and will not be explained in further detail here.

Detail C) shows a hole 73 through the core, which has been partially filled with PUR as also described above and detail D) is a variation of the embodiment, where the hole in the EPS core has been lined with a pipe 731. The liner 731 decreases the friction between the EPS and the PUR and helps the PUR to flow into the hole in the intended manner. The hole may be formed during moulding of the EPS core member, for example by arranging a mandrel in the mould, or formed afterwards, for example by drilling or melting.

Detail E) shows a fifth embodiment, where the hole 732 through the EPS is still open so that a bolt 701 can be passed through it and be fixated on the opposite side by a nut 702. As may be seen, the PUR layer 721 penetrates some distance into the hole 732 from both sides, but does not meet to form a continuous structure reaching from one side to the other as in detail C). This has the advantage that the frame is capable of yielding slightly, when the bolt and nut connection is tightened or affected by loads, hence minimizing the risk of the PUR layer rupturing either at the bridging portions inside the hole or at the outer surface of the frame. In detail E) the spaces between the ends of the PUR shell projecting into the hole is filled with EPS, but they may also be left open or filled with another compressible material. Shaping the parts of the PUR shell projecting into the hole may be achieved by using material that melts away or dissolves during the moulding of the PUR shell or by providing the EPS core with form parts made for example of thin plastic sheets, which may easily be penetrated afterwards if needed.

Details F) and G) shows the provision of an insert 74,75, which projects through the PUR layer and has projecting flanges 741,751, which are secured underneath the PUR layer. When the screw or peg 70 is forces into these inserts, the material thereof will yield and the flanges 741,751 will prevent the insert from being pulled out of the frame structure. If made from appropriate materials, such an insert 74,75 may serve as an electrical connector and it may then be connected to an insert inside the profile as shown in detail A). This may for example be used for supplying energy to blinds, shutters, opening devices, rain sensors or the like. An example of a hinge device which could be connected to such an electrical system is described in WO2010/003426. Moreover, such combinations of inserts could be used for lighting, if using optical fibers instead of electrical conductors, or even for ventilation, if providing a system canals in the frame profile.

Details H) and I) show corresponding inserts 76, 77 of a slightly more complex design, resembling the plugs commonly used when attaching screws to walls. These plugs have threadlike flanges 761, 771 on the outer sides contributing even further to prevent them from being pulled out and an inner lumen 762,772 designed to give room for the screw or peg 70 thus enabling the use of stiffer material than in details F) and G). The threading means that these inserts may be screwed into the core member.

In detail J) a pocket hole in the core members has been covered by a layer of PUR on its inner side and an insert 78 has subsequently or simultaneously been inserted in the hole to receive the screw or peg 70. As may be seen, the insert has barbs 781 on its outer side preventing it from being pulled out. This may be achieved by letting the PUR material set around a stiff insert or by making the PUR with a profiled surface and then causing the insert to fill the recessed in this surface, the insert then possibly being made from a material, which hardens upon insertion.

A similar insert 79 is shown in detail K), but here it is inserted in a block 791 of a different material provided in the core member and projecting underneath the PUR layer to prevent it from being pulled out. This block of material may be a stiff material or a setting material, such as glue, as described above.

It is to be understood that the embodiments shown in the details of FIG. 4 may be combined so that two or more of them occur in the same frame and that they may even be found at the same location on the frame, an example being that an insert as shown in detail A) may be found underneath a thickening of the PUR layer as shown in detail B).

Figure 5:
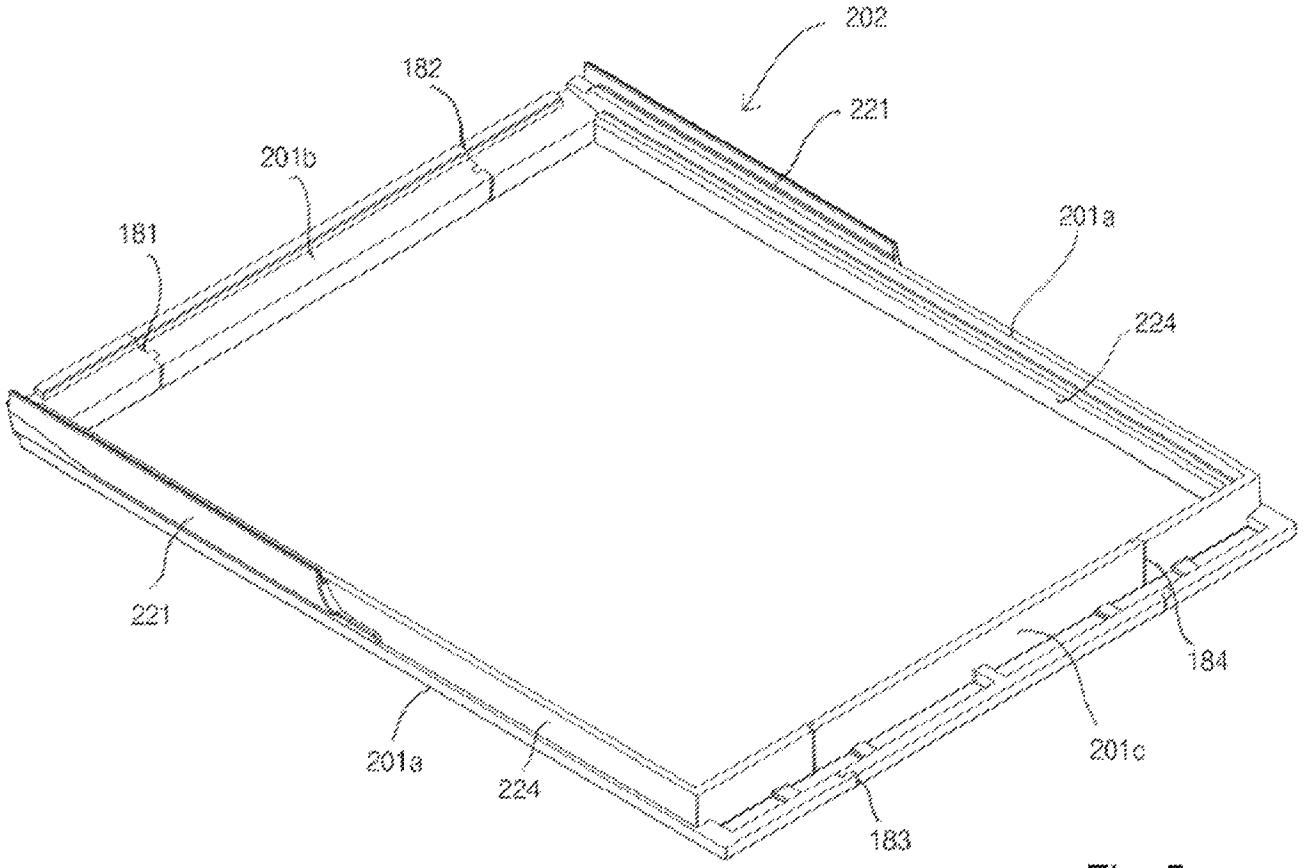
FIG. 5 is a perspective view showing a core of a window sash structure in a third embodiment of the invention.

Turning now to FIG. 5, an example of a core 202 for a frame structure according to the invention, here for use as a window sash, is shown prior to moulding of the PUR shell. As may be seen this core 202 is formed from four core pieces 201*a*, 201*b*, 202*c* corresponding to the side, bottom and top pieces of the frame structure, respectively, and assembled at joints 181, 182, 183, 184. To make moulding and assembly of the core members easier, the material intended to serve as core in the outermost ends of the top and bottom frame pieces are here part of the core side pieces 201*a*. This also means that the same core side pieces 201*a* may be used for making sash frames for any window of a particular length, whereas the width may be varied by simply choosing different top and bottom core pieces. In other cases, for example if instead making the core members by cutting or milling, other shapes of the respective core members and hence the location of the joints between them may be more expedient.

Each core piece may be composed of several core members as explained above. As an example, the striking bead 221 found on each of the side core pieces may be made separately and then attached to a less complex main side core member 224.

In FIG. 5, the joints 181, 182, 183, 184 are made as dovetail joints, which means that the core members are temporarily kept together until fixated by the PUR shell, but other types of joints, including simple butt joints, may of course by used, just as glue, adhesive, clamps, etc. may be used for a temporary fixation.

It is of course also possible to make the core 2, 102, 202 as an integral closed frame to avoid subsequent assembly operations, but this will set certain limits on the geometry of the frame structure.

The PUR shell is preferably applied by inserting the entire core in a PUR mould and then moulding the PUR shell around the core. Alternatively, the frame structure 1 may be manufactured by first moulding the outer shell 3, 103, possibly as two half-shells, with embedded reinforcing elements if needed and then filling the cavity with EPS.

Figure 6:
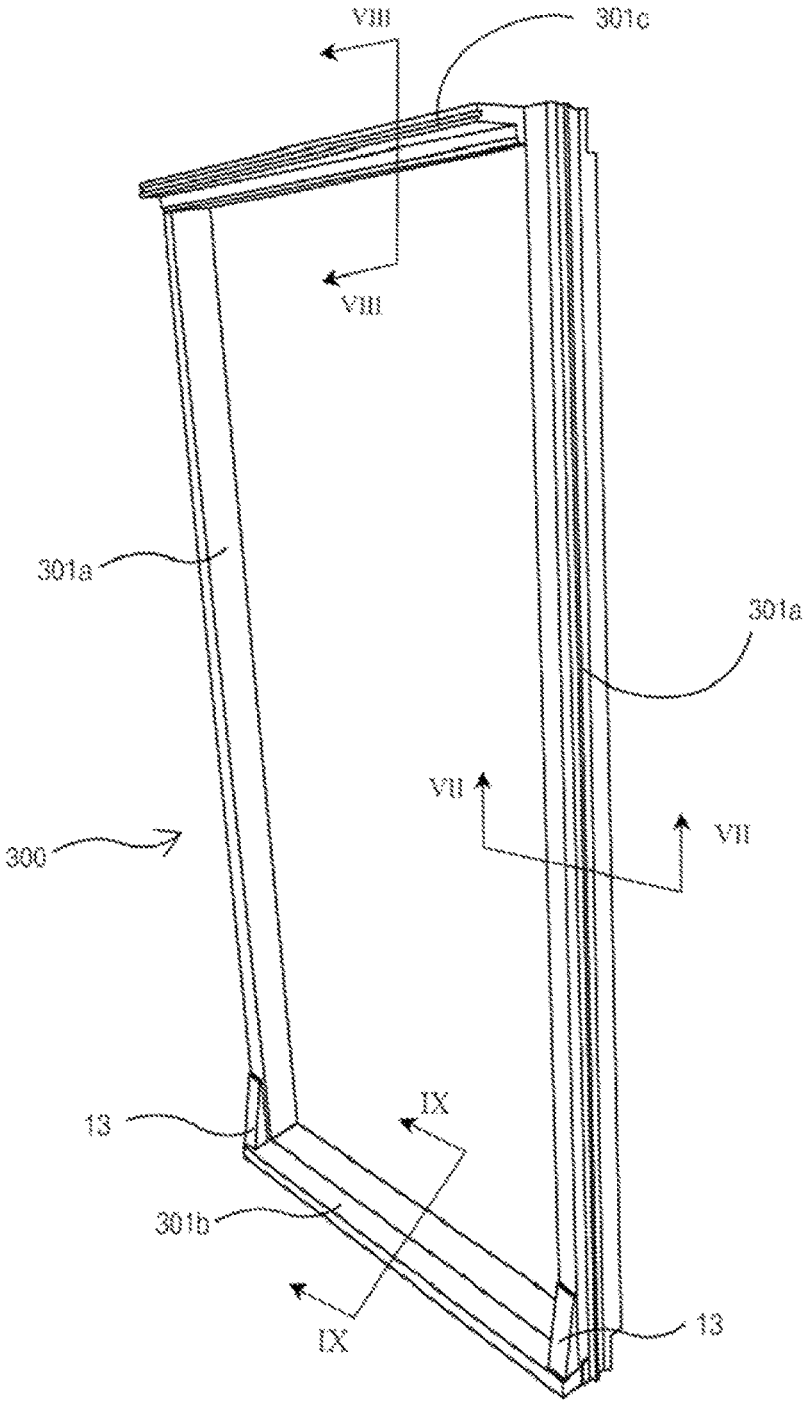
FIG. 6 is a side angle view photo of a core of a window frame prototype corresponding to a fourth embodiment of the invention.

FIG. 6 shows an alternative embodiment of a core for a frame structure according to the invention, here intended for a window frame. The frame core is assembled of straight core pieces 301*a*, 301*b*, 301*c* having uniform cross-section along the length thereof.

Here the EPS is dark colored due to the addition of a fire-retardant and other functional additives, such as for example a UV-stabilizer, may also be used depending on demands.

At the lowermost corner joints auxiliary wedge parts 13 are provided to strengthen the joint and provide a smooth transition between the side and bottom members. The wedge parts 13 are not necessarily made of EPS, but may be made of, for example, a polymer.

Figure 7:
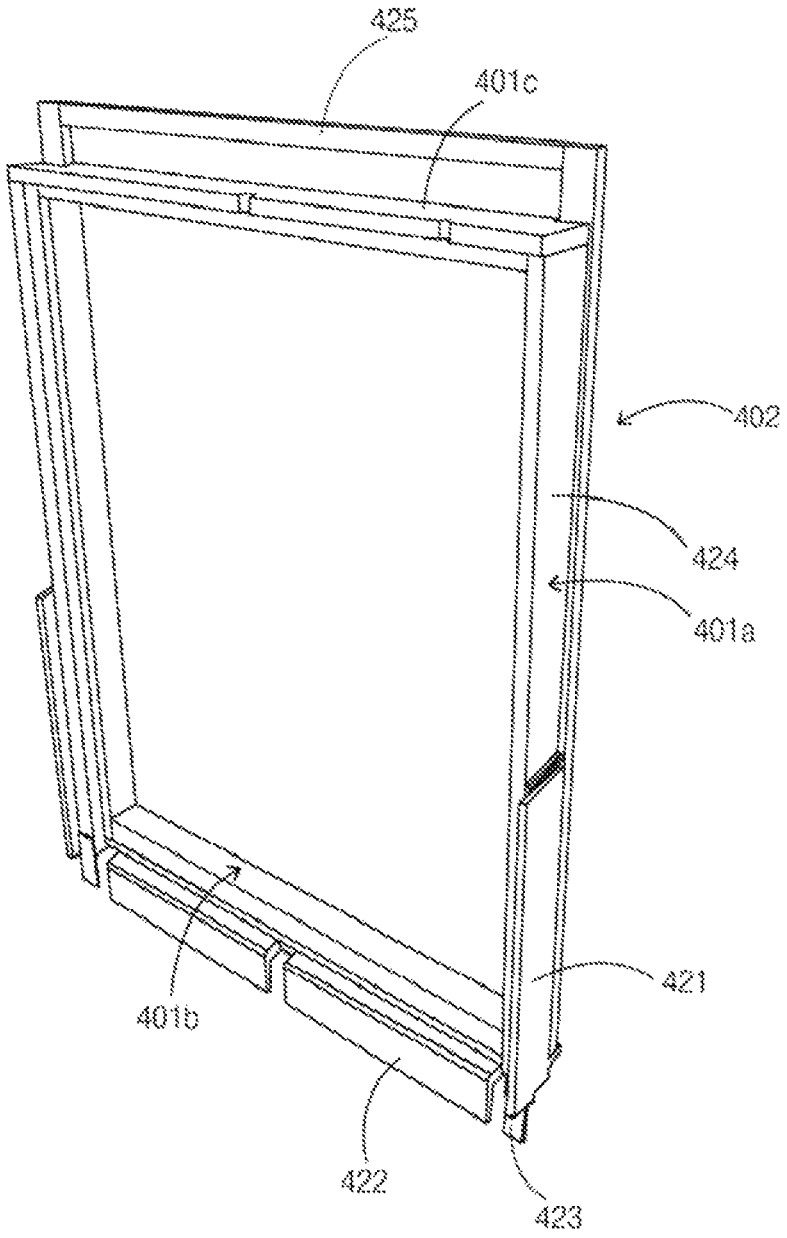
FIG. 7 is a side angle view photo of a core of a window sash prototype corresponding to a fifth embodiment of the invention.

Yet another embodiment of an assembled core 402 for a frame structure, here for a window sash, can be seen in FIG. 7. This core corresponds in shape to the one in FIG. 5, but here the striking beads 421 are made as separate core members of a different material than main members 424 of the side core pieces 401*a*, which are of a substantially constant cross sectional shape. Additional core members 422, 423 and 425 are used at the bottom core piece 401*b* and top core piece 401*c*.

In a manner known to the skilled person and illustrated in FIG. 1, the frame structure may be provided with a shielding arrangement. The shield may includes a cladding 10 having a first part substantially parallel with the upper and outwards facing side and a second part substantially perpendicular to the first part. Thus, the second part of cladding covers the outwards and sidewards facing part of frame member. In addition, coverings members 11 are provided for covering the joint between the frame and a window sash (not shown). The shield may also include a flashing (not shown) comprising a first part along the outwards and sidewards facing side of core member and a second part substantially perpendicular to the first part and adapted to be positioned substantially in parallel with and below the roofing in the mounted position. Such cladding, covering and flashing parts may be attached to or embedded in the PUR shell.

Considering the relatively low melting point of polystyrene, recycling of the materials use for the frame is relatively unproblematic. When using EPS without high temperature additives, the frame pieces can simply be heated to a temperature of approximately 200° C., where the polystyrene will have melted and can be separated from the polyurethane, which maintains it shape at this temperature.

With the profile element construction according to the invention, a versatile construction is achieved, which can be tailor-made to the requirements of a specific use. Hence it is clear that the profile element construction can be used as a frame or sash for a window or door, and the construction can be adapted to the specific use e.g. by incorporating more reinforcing elements.

While preferred embodiments of the invention have been shown and described, modifications and variations may be made thereto without departing from the spirit and scope of the present invention. Thus, it should be understood that various embodiments may be interchanged, both in whole or in part. Furthermore, those with skill in this technology will appreciate that the foregoing description is by way of example only and is not intended to be a limitation of the invention as further described in the appended claims.

The invention claimed is:

1. A method for making a window frame structure, comprising the steps of:

providing a core including at least one core member;

wherein the at least one core member comprises expanded polystyrene with a density of 80-200 kg/m$^3$ and further comprises one of a hole or canal, placing the core in a mould;

moulding polyurethane around the core thereby encasing the core; and filling the at least one of a hole or canal at least partially with polyurethane.

2. A method according to claim 1, wherein the core member further includes an insert that comprises a material other than expanded polystyrene, the insert being embedded in the core member during making thereof, placed inserted in or attached to the core member prior to it being encased in polyurethane, or placed in the core after encasement.

3. A method according to claim 1, further comprising providing a second core member, wherein, prior to being encased in the polyurethane shell, the at least one core member is joined to the second core member by means of dovetails, clamps, staples, welding, adhesives, glue or combinations thereof, including epoxy or an acrylic resin.

4. A method for making a frame structure of a window or door having a transparent sheet element, comprising the steps of:

providing a core including at least one core member;

wherein the at least one core member comprises expanded polystyrene with a density of 80-200 kg/m$^3$ and further comprises one of a hole or canal, placing the core in a mould;

moulding polyurethane around the core such that the at least one core member is surrounded by polyurethane so that no portion of the expanded polystyrene of the at least one core member directly contacts the transparent sheet element of the window or door when the frame structure is in an operating position; and filling the at least one of a hole or canal at least partially with polyurethane.

* * * * *